US005236778A

United States Patent [19]

Landis et al.

[11] Patent Number: 5,236,778

[45] Date of Patent: Aug. 17, 1993

[54] HIGHLY FILLED BINDER COATED FIBROUS BACKING SHEET

[75] Inventors: Roger K. Landis, York; Guy L. Markle, Mount Joy, both of Pa.

[73] Assignee: Armstrong World Industries, Inc., Lancaster, Pa.

[21] Appl. No.: 448,304

[22] Filed: Dec. 11, 1989

[51] Int. Cl.[5] ..... D04H 1/16

[52] U.S. Cl. ..... 428/282; 428/280; 428/281; 428/283; 428/284; 428/290; 428/335; 428/336

[58] Field of Search ..... 428/213, 215, 280, 282, 428/284, 262, 263, 289, 281, 334, 335, 336, 241, 283, 290, 331, 250

[56] References Cited

U.S. PATENT DOCUMENTS

| | | | |
|---|---|---|---|
| 2,624,683 | 1/1953 | Bezman | 428/280 |
| 2,742,377 | 4/1956 | Bezman | 428/280 |
| 2,980,575 | 4/1961 | Petry | 428/282 |
| 3,007,808 | 11/1961 | Smith | 428/282 |
| 3,122,444 | 2/1964 | Williams | 428/280 |
| 3,150,031 | 9/1964 | Powell | 428/282 |
| 3,167,464 | 1/1965 | Cook | 428/280 |
| 3,577,311 | 5/1971 | Reiter et al. | 428/282 |
| 3,627,566 | 12/1971 | Stichter et al. | 428/280 |
| 3,745,040 | 7/1973 | Morton et al. | 428/282 |
| 3,787,259 | 1/1974 | Kleinfeld et al. | 428/282 |
| 3,924,023 | 12/1975 | Boranian et al. | 428/334 |
| 4,066,813 | 1/1978 | Winters et al. | 428/289 |
| 4,225,383 | 9/1980 | McReynolds | 162/156 |
| 4,274,916 | 6/1981 | Grose | 162/145 |
| 4,373,992 | 2/1983 | Bondoc | 162/145 |
| 4,454,191 | 6/1984 | von Blücher | 428/264 |
| 4,714,651 | 12/1987 | Hartmann et al. | 428/289 |
| 4,957,806 | 9/1990 | Pangrazi et al. | 428/282 |

FOREIGN PATENT DOCUMENTS 0227853 7/1987 European Pat. Off. .

*Primary Examiner*—James J. Bell

[57] ABSTRACT

A fibrous backing sheet for a surface covering includes a layer of fibrous material and at least one resinous binder coating. The resinous binder is highly filled having a filler to binder ratio of at least 2:1. The coating is hydrophilic and has at least some porosity. Preferably, the thickness of the coating is at least 1 to 2 mils and at least 5% of the backing sheet.

9 Claims, 1 Drawing Sheet

HIGHLY FILLED BINDER COATED FIBROUS BACKING SHEET

BACKGROUND OF THE INVENTION

The present invention relates to a fibrous backing sheet for a surface covering. More particularly, the invention relates to a backing sheet which includes a coating of substantial thickness. Preferably, the coating is a highly filled, hydrophylic, resinous binder.

It is known to apply coatings to the fibrous material forming a backing sheet for a surface covering such as a floor. For example, see Grose U.S. Pat. No. 4,274,961. At column 9, lines 23 to 33, Grose states that fibrous backing sheet material often has a size or leveling coat applied to its surface prior to the application of one or more resinous polymeric compositions. He indicates that such a coat serves as a barrier coat preventing the migration of any of the impregnant or binder in the fibrous backing material into the overlying resinous polymer compositions. Further, he states the size coat often serves to provide good adhesion between the fibrous base backing material and the resinous polymeric composition.

However, Grose does not teach or suggest the use of a substantially thick coating. The size or leveling coats of the prior art are thin because the binder comprising the coat is expensive relative to the fibrous material of the backing sheet.

Further, Grose makes no mention of a filler in the coating composition. Rather, at column 9, lines 34 to 41, he states that the compositions are usually polyvinyl chloride homopolymers or copolymers. Such compositions are hydrophobic and are applied to deter water absorption by the fibrous sheet of asbestos or cellulosic fibers forming the backing sheet. Such water absorption leads to swelling and dimensional instability of the backing sheet.

European Patent Application 227,853 is directed to non-woven, fibrous composite materials in sheet form which are particularly useful as dimensionally stable backings and inner liners for surface covering laminates. As typical of the prior art, at page 13, lines 15 to 19, EPA 227,853 discloses a sizing or coating having nominal thickness of from about 0.1% to about 1% of the sheet. The sizing is a hard cationic acrylic latex which is applied to both sides of the composite sheet. There is no teaching or suggestion of a filler in the coating composition.

Highly filled sheets for use in floor coverings have been used such as disclosed in McReynolds U.S. Pat. No. 4,225,383. However, the high filler loading (60% to 95%) is part of the layer of fibrous material and not a coating. There is no teaching or suggestion in McReynolds of coating the fibrous layer.

Bondoc U.S. Pat. No. 4,373,992 also discloses a typical backing sheet composition which includes glass fibers, cellulosic fibers, synthetic organic fibers, inorganic filler, binder and calcium hydroxide. However, once again, there is no mention of coating the fibrous layer.

Cellulose fibers have been generally substituted by the floor covering industry for asbestos fibers which were previously used to form the backing felt in flooring structures. However, cellulose has a number of disadvantages including being hydroscopic. This leads to water absorption and dimensional instability.

Most flooring felt is "sized;", i.e., coated with a thin layer of binder to reduce the generation of dust during manufacture. The binder is hydrophobic which helps to improve water resistance but does not add substantially to the caliper or thickness of the felt. However, this hydrophobicity creates difficulties in adhering the flooring structure to the floor since most adhesives are water based.

One object of the present invention is to provide a coated fibrous backing sheet for a surface covering which maintains dimensional stability and yet improves compatability with water based adhesives to improve the adhesive bond or glueability.

SUMMARY OF THE INVENTION

The present invention provides a fibrous backing sheet for a surface covering including a layer of fibrous material and at least one resinous binder coating. The coating forms at least 5% of the overall thickness of the fibrous backing sheet. The resinous binder of the coating is highly filled, preferably, having a filler to binder ratio of at least 2:1. The high filler loading makes the coating hydrophilic and leads to porosity which improves the adhesive bonding between the fibrous backing sheet and any layer bonded to the fibrous backing sheet.

DETAILED DESCRIPTION OF THE INVENTION

The present invention is contrary to the teaching of the prior art. As discussed previously, the substitution of cellulosic fibers for asbestos fibers produces a fibrous material which is hydroscopic. Upon absorption of water, the fibrous material swells leading to dimensional instability problems. The solution of the prior art has been to coat the fibrous material layer with a thin layer of hydrophobic resinous binder. However, the hydrophobity of the binder coating creates difficulties in adhering the surface covering, such as a floor covering, to a floor substructure or other surface with water based adhesives.

Those skilled in the art have not added a filler to the resinous binder coating since this would reduce hydrophobity. However, the present inventors have found that a highly filled binder which is hydrophilic, and in fact somewhat porous, can be used if the coating is of sufficient thickness.

Figure 1:
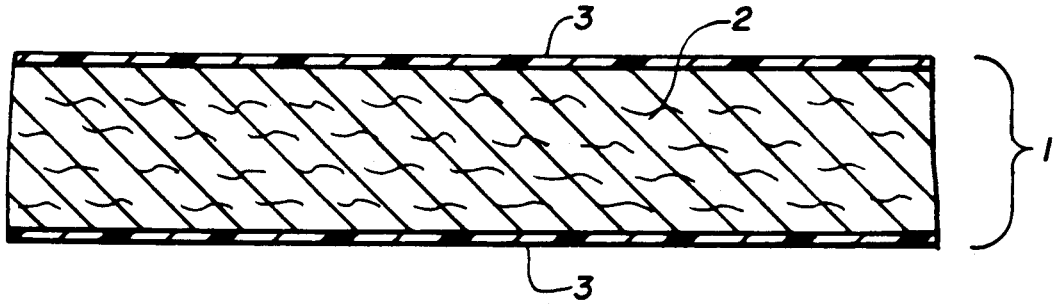
FIG. 1 is a cross-sectional view of one embodiment of a highly filled binder coated fibrous backing sheet.
Figure 2:
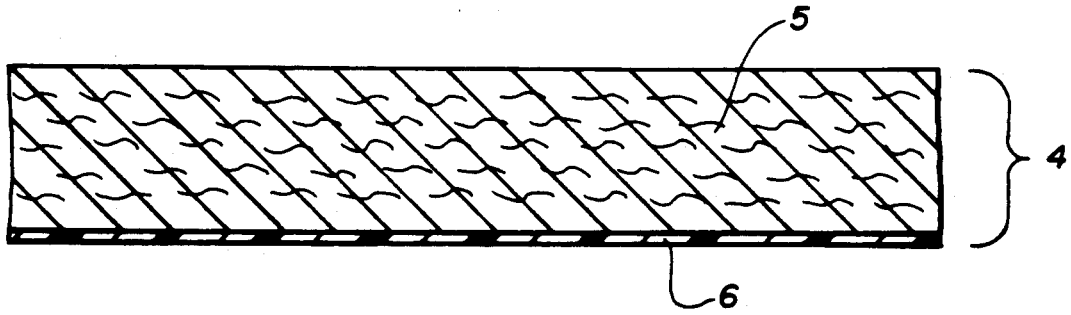
FIG. 2 is a cross-sectional view of a second embodiment of a highly filled binder coated fibrous backing sheet.

The present invention is a fibrous backing sheet such as 1 shown in FIG. 1 in which a flooring felt 2 is coated on both sides with a thick (1 to 5 mil or more), highly filled, water based latex forming coatings 3. In the second embodiment shown in FIG. 2, the backing sheet 4 is a flooring felt 5 coated on one side only with coating 6. The coating is hydrophilic since the latex binder is highly filled. Also, being highly filled there are numerous interstices which permit the absorption of water.

EXAMPLE

A typical coating formulation would include about 53% based on solid weight of precipitated calcium carbonate pigment, about 36% fine particle size Kaolin clay pigment, about 10.5% carboxylated styrene-butadiene latex, ¼% polyacrylic acid sodium salt dispersant and about ¼% tetrasodium pyrophosphate dispersant. The formulation is coated on the felt to a thickness of about 2 or 3 mils and oven dried. The coated felt is then calendered to smooth the surface of the coated felt without substantial loss of caliper or thickness.

Due to the substantial thickness and calendering, the surface of the present coated felt enhances the amount of detail which can be printed on the floor structure. Prior art sized felt has surfaces which are rough in comparison to the present coated felt. This unevenness is transmitted through the PVC layer which is applied to the felt and then rotogravure printed. If the PVC layer is a foamed PVC layer which are typically expanded to three times, the roughness is magnified.

The fibrous material layer, the components of the highly filled resinous binder coating and the methods of producing the coated fibrous backing sheet are well known in the art. The invention relates to the use of a highly filled resinous binder coating and the substantial thickness of the coating.

A highly filled resinous binder composition is defined to mean a resinous binder composition having 60 to 95% by weight of filler. The preferred binder is a latex or water-based emulsion, either natural or synthetic; more preferably an acrylic latex. The remaining components of the coating include binder and coating additives such as dispersing agents, viscosity modifiers, and other general purpose additives.

The resinous binder coatings of the prior art have been thin due mainly to the fact that the resin binder is one of the most expensive components by weight of the backing sheet. By adding a filler to the binder, the cost of the binder composition plummets to such an extent that a 1 mil thickness of coating may be less than the cost of 1 mil of the fibrous material layer.

The preferred fibrous backing sheet is a non-asbestos floor backing system having a highly filled resinous binder coating on both sides. The fibrous material layer is made using techniques and formulations standard in the art in making flooring felts.

The coatings may be applied by an off-line coater or an on-line coater. Any of the coaters of the prior art can be used. However, if the fibrous layer is calendered, a reverse roll coater is preferred. An air knife coater would eliminate blade streaks.

In a preferred backing sheet, the target solids for the pigment slurry is 72%. The pigment slurry can be made up in any of several commercially available pigment dispersing vessels. The dispersing vessel was charged with water sufficient for 72% final solids, 0.25 dry parts by weight of tetrasodium pyrophosphate dispersant, 0.25 dry parts by weight sodium polyacrylic dispersant, 53 dry parts by weight precipitated calcium carbonate and 36 dry parts by weight fine particles size kaolin.

Once an adequate level of pigment dispersion has been reached, the pigment slurry was passed through a screen. A 100-mesh screen has been successfully used. Reasonable care should be exercised so that excessive air is not entrained in the slurry.

The preferred binder composition was formulated by adding 10.5 dry parts by weight of a carboxylated styrene-butadiene latex. The latex used was approximately 64% bound styrene. The latex was blended under relatively low sheer conditions as high sheer can destabilize latex emulsion. As previously, care should be exercised to avoid excessive entrained air in the coating.

The coating line should be capable of handling webs of at least 4 meters wide plus trim. Of course, lines should be capable of being deckled down to handle narrow widths, such as 6 and 9 feet.

Preferably, the coating line will be able to coat both sides of the fibrous material layer or felt web during a single pass through the coating line. This will require two separate coating heads with separate coating supply systems and drying ovens for each head. A bent blade coater has given the best results. The vent blade coating head should be capable of adjusting and controlling blade angle, blade loading pressure and blade extension. Other important factors include the thickness of the blade and the speed at which the coating operation takes place.

Most of the work done to date has been at a coating speed of 200 to 300 feet per minute. However, the coater should be capable of applying coatings at speeds of at least 500 feet per minute. The coating service system should be capable of supplying at least 100 wet pounds of coating per minute for each head.

Floater ovens have successfully been used to dry the coatings applied during pilot tests. These ovens are standard in the industry and should have a capacity to dry a coating containing 30 to 50% water being applied at a rate of 50 wet pounds per 100 square yards at a web speed of 500 feet per minute.

Gloss calendering has been demonstrated to be a very effective method of smoothing a coated felt without a substantial caliper or thickness loss. A nip pressure of 500 pounds per inch has been successfully used.

Modifications to the equipment and composition components would be obvious to those skilled in the art and are included within the scope of the present invention. For example, conventional fillers, such as talc, ground limestone and satin white may be used.

We claim:

1. A fibrous backing sheet for a floor covering laminate comprising a layer of fibrous material and at least one resinous water-based latex binder coating, said coating being porous, said resinous binder coating comprising 60 to 95% by weight of filler.

2. The backing sheet of claim 1 wherein the backing sheet comprises two resinous binder coatings, the binder of the two coatings comprising 60 to 95% by weight of filler, the layer of fibrous material being disposed between the two coatings.

3. The backing sheet of claim 1 wherein the resinous binder has a filler to binder ratio of at least 2:1.

4. The backing sheet of claim 1 wherein the coating is hydrophilic.

5. The backing sheet of claim 1 wherein the coating is at least 1 mil in thickness.

6. The backing sheet of claim 1 wherein the water-based latex is an acrylic latex.

7. The backing sheet of claim 1 wherein the latex is a carboxylated styrene-butadiene latex.

8. The backing sheet of claim 1 wherein the thickness of the coating is at least 5% of the thickness of the backing sheet.

9. A floor covering laminate comprising a layer of fibrous material, a vinyl decorative layer and at least one resinous water-based latex binder coating on said fibrous layer, said coating being porous.

* * * * *